US008729997B2

(12) United States Patent
Kobayashi

(10) Patent No.: US 8,729,997 B2
(45) Date of Patent: May 20, 2014

(54) DIPOLE-RING MAGNETIC CIRCUIT

(75) Inventor: Hideki Kobayashi, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 13/285,594

(22) Filed: Oct. 31, 2011

(65) Prior Publication Data

US 2012/0112864 A1 May 10, 2012

(30) Foreign Application Priority Data

Nov. 5, 2010 (JP) ..... 2010-248475

(51) Int. Cl.
*H01F 7/02* (2006.01)

(52) U.S. Cl.
USPC ..... 335/306; 335/302

(58) Field of Classification Search
USPC ..... 335/296, 302–306
See application file for complete search history.

(56) References Cited

U.S. PATENT DOCUMENTS

| | | | | |
|---|---|---|---|---|
| 6,214,480 | B1 * | 4/2001 | Hosoe et al. | 428/615 |
| 6,396,378 | B1 * | 5/2002 | Leupold | 335/306 |
| 6,768,407 | B2 * | 7/2004 | Kohda et al. | 335/306 |
| 2008/0245442 | A1 | 10/2008 | Nakamura et al. | |
| 2011/0210810 | A1 * | 9/2011 | Miyata et al. | 335/302 |

FOREIGN PATENT DOCUMENTS

| | | |
|---|---|---|
| JP | 2000-219965 | 8/2000 |
| JP | 2004-119822 | 4/2004 |
| JP | 2006-294851 | 10/2006 |
| JP | 2010-135529 | 6/2010 |
| WO | WO 2006/043348 A1 | 4/2006 |

OTHER PUBLICATIONS

Machida et al. "Grain Boundary Modification and Magnetic Properties of Nd—Fe—B Sintered Magnets", *Abstracts of Spring Meetinf o Japan Society of Powder and Powder Metallurgy*3 pages (2004).

* cited by examiner

*Primary Examiner* — Bernard Rojas
(74) *Attorney, Agent, or Firm* — Myers Bigel Sibley & Sajovec, P.A.

(57) ABSTRACT

The present invention provides a dipole-ring magnetic circuit having a greater magnetic field strength and demagnetization resistance. A dipole-ring magnetic circuit including permanent magnet pieces arranged in an annular shape that magnetization directions make one rotation halfway around the shape, in which the permanent magnet pieces produce a substantially one-directional magnetic field at a uniform strength in an interior space surrounded by the permanent magnet pieces; two or more specified magnet pieces have a magnetization direction of forming an angle of from 150 to 210 degrees with respect to the direction of the magnetic field which is on a plane perpendicular to a central axis of the annular shape, and are called "specified magnet pieces"; and at least in each of the specified magnet pieces, a value of magnetic coercive force increases with decreasing distance to the interior space along a radial direction of the annular shape.

11 Claims, 2 Drawing Sheets

DIPOLE-RING MAGNETIC CIRCUIT

CROSS-RELATED APPLICATIONS

This application claims priority from Japanese Patent Application No. 2010-248475; filed Nov. 5, 2010, the disclosure of which is incorporated herein by reference in its entirety.

BACKGROUND OF THE INVENTION

The present invention relates to a dipole-ring magnetic circuit which can generate a magnetic field space in which magnetic field directions are aligned in one direction and the magnetic field strength is substantially uniform in an interior space of the magnetic circuit. Such a dipole-ring magnetic circuit is widely used in magnetic resonance imaging (MRI) devices, processes for manufacturing semiconductor device, and apparatuses for generating magnetic field used in basic research. Among others, it is expected that usage of the magnetic circuit will expand in the future in a magnetic-field annealing in the manufacturing processes for semiconductor device.

As shown in FIG. 4A, a dipole-ring magnetic circuit 101 has, an annular shape, and includes a plurality of permanent magnet pieces 103 arranged in a case 105 such that magnetization direction 104 of each magnet piece makes one rotation halfway around the annulus, thereby generating a magnetic field space 107 in a certain interior space in the annulus, in which magnetic field space 107 has a one-directional magnetic field direction 109 and a uniform magnetic field strength (JP2006-294851A). As shown in FIG. 4B, the magnetic circuit has a certain length in an axial direction thereof and forms a uniform magnetic field space 107 having a finite length in the axial direction in the interior space. That is, the magnetic circuit produces the uniform magnetic field space 107 of a cylindrical shape in the interior space.

The dipole-ring magnetic circuit is used in processes or devices which require a magnetic field space having a uniform magnetic field strength and a one-directional magnetic field. In recent years, it is also used in the annealing step in the manufacturing process for magneto-resistance devices (JP2004-119822A). Besides a resistive magnet type and a superconductive magnet type magnetic-field annealing, a permanent magnet type magnetic-field annealing have been increasingly used not only for producing magnetic fields with low strength, but also for producing magnetic fields with strength no less than 1 T (Tesla) in view of recent improvement in the performance of permanent magnets and power saving.

In order to improve the treating capacity of annealing, the above described uniform magnetic field space is preferably as large as possible. To increase the diameter of the magnetic field space, an inner diameter of the magnetic circuit needs to be increased. To increase the length of the magnetic field space, the length of the magnetic circuit needs to be increased. If the inner diameter is simply increased, it will cause the magnetic field strength to decline. Thus, the outer diameter of the magnetic circuit also needs to be increased to expand the magnetic field space, thereby maintaining the magnetic field strength. Accordingly, this leads to an up-scaling of size and weight of the whole.

Sintered NdFeB rare-earth magnets are predominantly used for the dipole-ring magnetic circuit because they have greater residual magnetization and greater magnetic coercive force than other magnets. A magnet will be demagnetized if a reverse magnetic field which is larger than its magnetic coercive force acts thereon. To prevent demagnetization during its use, a magnet having a magnetic coercive force greater than the reverse magnetic field acting thereon is used. However, in general, when the magnetic coercive force of a sintered NdFeB magnet is made greater, the residual magnetization of the sintered NdFeB magnet becomes lower, and vice versa. Therefore, using a magnet having an excessively high magnetic coercive force might lead to a decline of the strength of the magnetic field to be produced.

In recent years, there are reported techniques for improving a magnetic coercive force without decreasing residual magnetization by diffusing Dy (Dysprosium) or Tb (Terbium) from the surface of a sintered magnet to its interior, as seen in International Publication of WO2006/043348, and Machida K., Kawasaki T., Suzuki S., Itoh M., and Horikawa T., "Improvement of Grain Boundaries and Magnetic Properties of Nd—Fe—B Sintered Magnets (in Japanese)," Abstracts of Spring Meeting, p 202, 2004, Japan Society of Powder and Powder Metallurgy. Since such techniques can effectively concentrate Dy and Tb at grain boundaries, it is possible to increase the magnetic coercive force with almost no decrease of residual magnetization. Furthermore, since the smaller the dimension of the magnet, the deeper the added Dy or Tb diffuses into the interior, this diffusion treatment method can be applied to a small or thin magnet.

If such a treatment to diffuse Dy or Tb from the magnet surface is applied to a magnet which is not compact in size, the magnetic coercive force will not increase in the magnet interior as described in JP2010-135529A, and the magnetic coercive force will gradually increase from the interior to the surface, thus requiring attention during its use.

SUMMARY OF THE INVENTION

In view of the above, an object of the present invention is to provide a dipole-ring magnetic circuit having a greater magnetic field strength and improved demagnetization resistance.

In order to achieve the above object, the inventor have found and taken an advantage of the fact that by allowing at least some of permanent magnet pieces comprised by a cylindrical dipole-ring magnetic circuit to have the value of magnetic coercive force increased with decreasing distance to an interior space along a radial direction of a cylinder, the magnetic field strength of the interior space can be improved while preventing the demagnetization of the at least some magnet pieces.

According to one aspect of the present invention, permanent magnet pieces having a greater residual magnetization and a greater magnetic coercive force which increases with decreasing distance to the interior space along the radial direction of the cylinder are used as magnet pieces (hereafter, referred to as "specified magnet pieces") having a magnetization direction of forming an angle of from 150 to 210 degrees with respect to the direction of the uniform magnetic field which is on a plane perpendicular to the central axis of the cylindrical dipole-ring magnetic circuit. Accordingly, the magnetic circuit can produce a uniform magnetic field space having a magnetic field strength greater than in the conventional circuit. Furthermore, when the dipole-ring magnetic circuit according to the present invention has a magnetic field space having the same magnetic field strength and the same uniformity of magnetic field as in the conventional circuit, reduction in size and weight of the dipole-ring magnetic circuit with respect to those of the conventional circuit can be achieved, because a volume of magnet piece required can be reduced.

Furthermore, the specified magnet pieces may have a greater magnetic coercive force than those of the other magnet pieces, or some or all of the specified magnet pieces may be divided in the radial direction into magnet parts wherein magnet parts at an inner periphery side may have a greater magnetic coercive force so that this magnetic circuit can provide a uniform magnetic field space having a greater magnetic field strength than that of the conventional circuit. Furthermore, when the dipole-ring magnetic circuit according to the present invention has a magnetic field space having the same magnetic field strength and the same uniformity of magnetic field as in the conventional circuit, reduction in size and weight of the dipole-ring magnetic circuit with respect to those of the conventional circuit can be achieved.

A dipole-ring magnetic circuit with the improved magnetic field strength as described so far can be used in processes or devices which require a greater magnetic field strength. Furthermore, this magnetic circuit can be reduced in size and weight compared with the conventional circuit having a magnetic field space of the same magnetic field strength and the same uniformity of magnetic field. Accordingly, when this magnetic circuit is used in a semiconductor manufacturing apparatus, for example, size and weight reduction of the whole apparatus can be achieved. Furthermore, compared with the conventional circuit having a magnetic field space of the same magnetic field strength and the same uniformity of magnetic field, this magnetic circuit can further increase the inner diameter of the magnetic circuit than in the conventional circuit. Accordingly, when this magnetic circuit is used in a semiconductor manufacturing apparatus, for example, usable interior space can be expanded, and a conveying system and heating system to be disposed in this interior space can be more freely designed.

DETAILED DESCRIPTION OF THE PREFERRED EMBODIMENTS

Figure 1A:
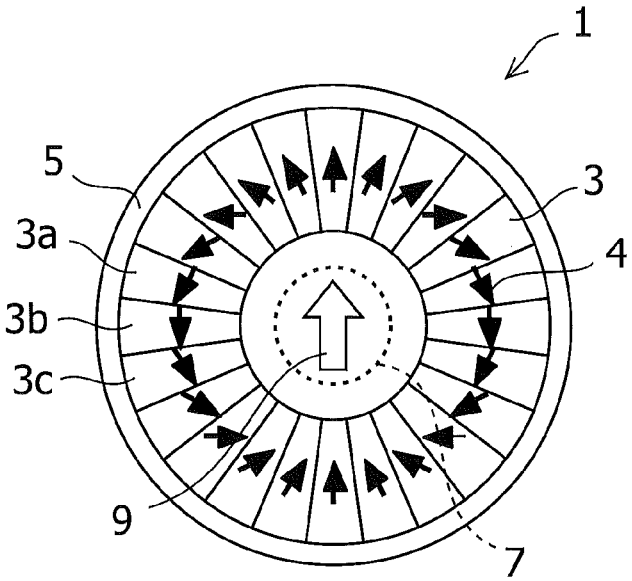
FIG. 1A is a cross-sectional view perpendicular to a central axis of a cylinder of a dipole-ring magnetic circuit 1 according to one aspect of the present invention.

The present invention now will be described more fully hereinafter in which embodiments of the invention are provided with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs.

FIG. 1 illustrates a magnetic circuit according to one embodiment of the present invention. A magnetic circuit 1 comprises a plurality of permanent magnet pieces 3 which forms an annular shape in an outer periphery and is arranged such that the magnetization direction of each magnet piece makes one rotation halfway around the annulus. This arrangement produces the magnetic fields in an interior space 7 to be aligned in one direction 9 and to have a uniform strength. Each magnet piece 3 has approximately a fan-shape (concentric arc-shape) or trapezoidal shape, and is placed in a case 5 of a ring (cylinder) shape so as to form the annular shape as the whole. The magnet piece 3 can be connected to the case 5 and other magnet pieces by adhesion with an adhesive, etc. When the entire magnetic circuit 1 is divided into 24 magnet pieces, for example, it is configured such that a magnetization direction 4 of each magnet piece changes by 30 degrees between the adjoining magnet pieces so as to rotate by 360 degrees halfway around the annulus. The number of the divisional magnet pieces that the circuit comprises is preferably from about 12 to about 36 because an excessively small number of divisions will reduce the uniformity of magnetic field, and an excessively large number of divisions will increase the manufacturing cost. When 36 divisional magnet pieces are employed, the magnetic direction changes by 20 degrees between the adjoining magnet pieces.

Among the permanent magnet pieces 3 configured as described above, the specified magnet pieces are provided by using magnet pieces in which the value of magnetic coercive force increases with decreasing distance to the interior space along the radial direction of the cylinder. For example, referring to the magnetic circuit of FIG. 1, three specified magnet pieces are provided in the right half of the circuit, and three specified magnet pieces in the left half of the circuit, and accordingly a total of six specified magnet pieces are provided. Magnet pieces 3*a*, 3*b*, and 3*c* have the magnetization directions 4 which have angle differences of 150, 180, and 210 degrees, respectively, with respect to the uniform magnetic field direction 9. Each of the magnet pieces has the value of magnetic coercive force greater at the inner peripheral surface of the magnet piece than at the center of the interior thereof.

Figure 1B:
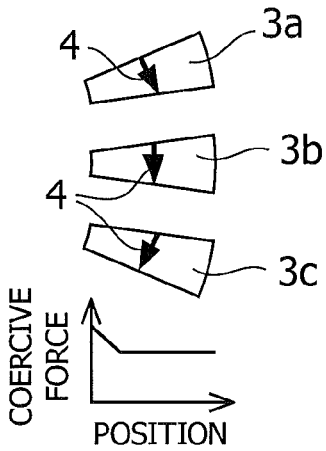
FIG. 1B is a conceptual diagram to illustrate a typical magnetic coercive force distribution for three magnet pieces that have the predetermined magnetization directions in FIG. 1A.

FIG. 1B illustrates the state of a typical magnetic coercive force for three magnet pieces on the right half of the circuit indicated in FIG. 1A, in a case where a diffusion treatment of Dy or Tb has been applied from the inner peripheral surface for the six specified magnet pieces. In FIG. 1B, while the magnetic coercive force value at the center of the interior of each of the specified magnet pieces is constant, the value increases substantially inversely proportional to the distance of reaching the inner peripheral surface at a predetermined depth of each magnet piece along the radial direction.

Figure 2:
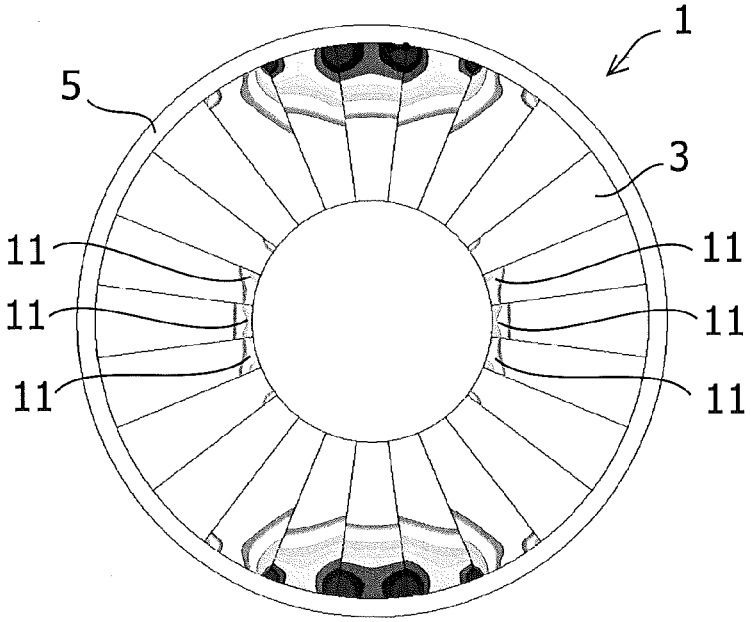
FIG. 2 is a strength distribution diagram of a reverse magnetic field that acts on each portion of magnet pieces of the dipole-ring magnetic circuit 1 according to one aspect of the present invention.

Referring to FIG. 2, the effectiveness of a magnet piece having such a distribution of magnetic coercive force as used in the dipole-ring magnetic circuit will be described. FIG. 2 illustrates a state of the reverse magnetic field that acts on various parts of magnet pieces of the dipole-ring magnetic circuit. As seen in FIG. 2, a strong reverse magnetic field acts in inner periphery side regions 11 of specified magnet pieces. That is, demagnetization of magnet piece has become likely to occur in this region. Accordingly, it may be necessary to use a magnet piece having a greater magnetic coercive force so as to be able to withstand the reverse magnetic field. However, if the whole magnetic circuit is made of magnet pieces having a greater magnetic coercive force, the residual magnetization will decline and the magnetic field to be produced might be decreased in strength.

Accordingly, in one of embodiments of the present invention, adopted is a technique in which magnet pieces that have undergone a diffusion treatment of Dy or Tb from the inner peripheral surfaces thereof are used as specified magnet pieces which are to be subjected to a strong reverse magnetic field. This enables the magnetic coercive force in the inner periphery side region to be increased, thereby inhibiting the occurrence of demagnetization, and a strong magnetic field to be generated in the interior space without a decline of residual magnetization. As described above, magnet pieces that have undergone a diffusion treatment have the increased magnetic coercive force while remaining the greater value of residual magnetization. By using such magnet pieces as the specific magnet pieces, the strength of the magnetic field of the uniform magnetic field space in the interior of the magnetic circuit can be increased. Accordingly, such magnetic circuit can be used in processes and devices which require a greater magnetic field strength. Further, since this magnetic circuit can be reduced in size and weight compared with the conventional circuit having a magnetic field space of the same magnetic field strength and the same uniformity of magnetic field, when this magnetic circuit is used in a semiconductor manufacturing apparatus, for example, size and weight reduction of the whole apparatus can be achieved. Furthermore, compared with the conventional circuit having a magnetic field space of the same magnetic field strength and the same uniformity of magnetic field, this magnet circuit can be further increased in the inner diameter of the magnetic circuit than in the conventional circuit. Accordingly, when this magnetic circuit is used in a semiconductor manufacturing apparatus, for example, this magnetic circuit can expand the usable interior space thereof, and thus a conveying system and heating system to be disposed in this space can be more freely designed.

The approach for diffusing Dy or Tb from the surface toward the inside of the magnet in the coating method or the sputtering method is described in WO2006/043348A1 and can be sometimes called "surface treatment by a grain boundary diffusion alloy method". In this method, preferably, a sintered magnet body and powder present on the surface of the sintered magnet body are thermally treated at a temperature lower than or equal to a sintering temperature of the sintered magnet body under a vacuum or an inert gas. The powder comprises one or more selected from the group consisting of oxides, fluorides and acid fluorides of one or more elements selected from rare earth elements including Y and Sc. The sintered magnet body may be preferably a sintered magnet body having an $R^1$—Fe—B composition wherein $R^1$ represents one or more selected from rare earth elements including Y and Sc.

However, there is a limitation on an area in which the magnetic coercive force can be increased by a diffusion treatment. Thus, if a magnet piece that has undergone a diffusion treatment is used in a magnetic circuit of an excessively large size, an advantageous increase in magnetic coercive force may not be achieved.

According to JP2010-135529A, the increase in the magnetic coercive force by a diffusion treatment can be obtained up to a depth of about 6 mm from the surface of the treated magnet. The region 11 in FIG. 2 where the strong reverse magnetic field is acted on, is from about ⅕ to 1/25 of the radial dimension of the magnet piece from the inner peripheral surface (the surface facing the space where a uniform magnetic field is produced) toward the outer peripheral surface (the surface not facing the space where a uniform magnetic field is produced). Therefore, when the radial dimension of the magnet piece is from about 30 to about 150 mm, the size of the reverse magnetic field region coincide with the size of the region where the magnetic coercive force increases by a diffusion treatment. When the radial dimension of the magnet piece is much larger than 150 mm, the size of the region 11 of the reverse magnetic field will become much greater than the distance of 6 mm at which the increase of a magnetic coercive force by a diffusion treatment can be obtained, and thus the reverse magnetic field region cannot be negated by the region in which the magnetic coercive force is increased by the diffusion treatment. When the radial dimension of the magnet piece is less than 30 mm, although the region where the magnetic coercive force is increased by a diffusion treatment will become larger than the reverse magnetic field region, that will have no adverse effect on the dipole-ring magnetic circuit and an apparatus incorporating it. Thus, the present invention is also effective for magnet pieces of which the radial dimension is not more than 30 mm. However, when the magnet piece is too small, the magnetic field to be generated declines in strength and there may be, for example, a case where the performance of a semiconductor device declines after a magnetic-field annealing process. Therefore, the radial dimension of the magnet piece is preferably at least 20 mm.

As so far described, by using a magnet piece that has undergone a diffusion treatment of Dy or Tb in a dipole-ring magnetic circuit, it is possible to increase the strength of the magnetic field of the uniform magnetic field space.

The magnet piece to be used is preferably a sintered rare-earth magnet. A sintered rare-earth magnet has both a far more improved residual magnetization and magnetic coercive force compared with other magnets. Therefore, a sintered rare-earth magnet is a magnet material suitable for the dipole-ring magnetic circuit. Moreover, since sintered NdFeB rare-earth magnets have lower costs and more improved residual magnetization than sintered SmCo rare-earth magnets, the sintered NdFeB rare-earth magnet is more preferable especially for a large-size dipole-ring magnetic circuit. Furthermore, the above described diffusion treatment is a treatment effective particularly for the sintered NdFeB rare-earth magnets.

As described above, while a magnet piece in which the value of magnetic coercive force is greater in a region closer to the inner periphery side of the magnetic circuit than in the center of the magnet piece interior is used at least for specified magnet pieces, such a magnet piece may be formed by diffusing Dy or Tb from the magnet piece surface to the interior thereof by a coating method or a sputtering method. Since it is enough if the magnetic coercive force is increased only in the inner periphery side region by a diffusion treatment, only the inner peripheral surface of the magnet piece may be treated in the diffusion treatment process. For example, the diffusion treatment may be performed with the surfaces other than the surface to be treated being masked. However, if treating only one surface of the magnet piece in the coating method or sputtering method causes additional costs and/or impairs the productivity due to the introduction of an extra process such as masking compared with an all-surface overall treatment, the all-surface or multi-surface overall treatment instead of one surface treatment may be performed. In this case, although the magnetic coercive force is increased in all the surfaces that have been treated, that will not adversely affect the magnetic circuit and there will be no problem provided when the magnetic coercive force in the inner periphery side is increased.

Figure 3:
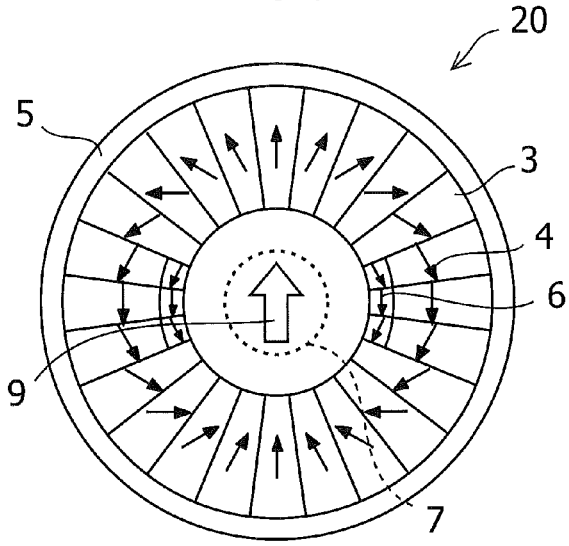
FIG. 3 is a cross-sectional view perpendicular to a central axis of a cylinder of a dipole-ring magnetic circuit 20 according to another aspect of the present invention.
Figure 4A:
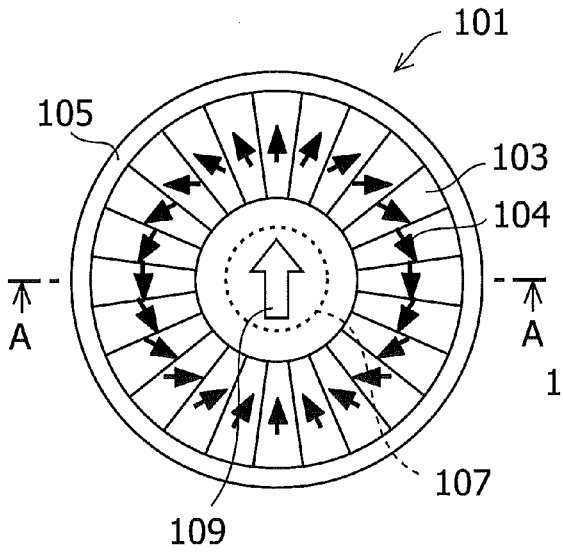
FIG.4A (RELATED ART)
FIG. 4A is a cross-sectional view in a plane perpendicular to a central axis of a cylinder of a conventional dipole-ring magnetic circuit 101.
Figure 4B:
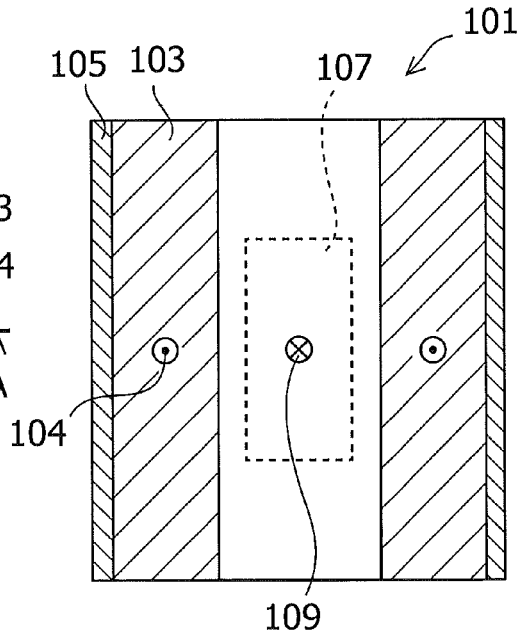
FIG.4B (RELATED ART)
FIG. 4B is a cross-sectional view taken along A-A in FIG. 4A.

The second embodiment of the present invention will be described referring to FIG. 3. A magnet piece which is subjected to a reverse magnetic field may be divided into two parts in the radial direction, that is, the radiation direction perpendicular to the central axis of cylinder. An inner magnet part 6 having a greater magnetic coercive force is placed in the inner periphery side, that is, in the inner side facing the interior space where a uniform magnetic field is produced. Thus, placing a magnet having a greater magnetic coerce force in the inner periphery side can prevent the demagnetization. There may be no need of increasing the magnetic coercive force of the outer magnet part that is placed in the outer periphery side, and a magnet having a greater residual magnetization may be used therein. Therefore, by placing a magnet having a greater magnetic coercive force only in the inner periphery side, it is possible to increase the magnetic field strength of the interior space 7 compared with the embodiment in which each of the magnet pieces has a greater magnetic coercive force to prevent demagnetization without dividing the magnet piece. The size of the divisional parts may be determined taking into consideration the size of the reverse magnetic field region. The size of the region where the reverse magnetic field is strong is from about ⅕ to about 1/25 of the radial dimension of the magnet piece from the inner peripheral surface toward the outer peripheral surface as described above, and thus the dimension of the magnet parts may be determined within this range.

According to the present embodiment, since the entire inner magnet part in the inner periphery side can have an increased magnetic coercive force, there is no limitation in the area or the radial dimension of the magnet piece in which the magnetic coercive force can be increased, contrary to the first embodiment. It is noted that the number of divisions is not limited to two, and may be three or more. It is preferable that the inner magnet part in the inner periphery side and the outer magnet part in the outer periphery side have parallel magnetization directions. The magnet piece may be divided along a concentric circle having a different diameter so as to fit the outer peripheral shape thereof, or may be divided in a linear fashion. The division of magnet pieces may be carried out by dividing one magnet piece into two or more pieces.

In the third embodiment of the present invention, a magnet piece which is subjected to a strong reverse magnetic field and which has angle difference of from 150 to 210 degrees in the magnetization direction with respect to the magnetic field direction, has a greater magnetic coercive force than those of the other magnet pieces. This can resist the reverse magnetic field and prevent demagnetization. In the other magnet pieces, there may be no need of increasing the magnetic coercive force so that magnets having a high residual magnetization may be used. Therefore, by using magnet pieces having a greater magnetic coercive force only for the magnet pieces that are subjected to a reverse magnetic field, it is possible to increase the magnetic field strength in the interior space compared with the magnetic circuit in which only magnets having a greater magnetic coercive force are used to prevent demagnetization. According to the present embodiment, since the magnetic coercive force is increased in the whole region of the magnet piece having a greater magnetic coercive force, there is no limitation in the area or the radial dimension of the magnet piece, contrary to the first embodiment. Moreover, the present method can be advantageous in cost because there is included no diffusion treatment process, contrary to the first embodiment, and there is no need of dividing the magnet piece, contrary to the second embodiment.

The maximum difference (the difference between the maximum and minimum values) in the magnetic coercive force in the above described specified magnet pieces, or the maximum difference in the magnetic coercive force between the above described specified magnet pieces and the other magnet pieces preferably exceeds 200 kA/m, and more preferably at least 300 kA/m.

Although the above described embodiments referred to the case of a dipole-ring magnetic circuit in which the magnetic circuit comprises 24-division magnet pieces, the present invention can be applied to the embodiment of different number of divisions. For example, in an embodiment of 36-division magnetic circuit in which the magnetization direction of each magnet piece changes by 20 degrees, in accordance with the present invention, targeted are six magnet pieces for which the angle difference between the magnetic field direction and the magnetization direction is within a range from 150 to 210 degrees, specifically 160, 180, and 200 degrees.

It is noted that the magnetic circuit of the present invention includes not only embodiments in which only the specified magnet pieces have the above described magnetic coercive force characteristics as described above, but also embodiments in which permanent magnet pieces of which angle difference is outside the range from 150 to 210 degrees also have the above described magnetic coercive force characteristics. In other words, it should not be construed that embodiments in which any magnet piece excepting the specified magnet pieces has a feature that has been described above relating to the specified magnet pieces are excluded.

EXAMPLES

Hereafter, specific embodiments of the present invention will be described in detail by way of examples. However, it should not be construed that the present invention is limited to those examples.

Example 1

In a dipole-ring magnetic circuit shown in FIG. 1A, magnet pieces were configured to have an inner diameter of 220 mm, an outer diameter of 500 mm and a height of 600 mm, and a sintered NdFeB magnet having a residual magnetization of 1.42 T and a magnetic coercive force of 900 kA/m was used for the magnet piece. Among the magnet pieces included in the magnetic circuit, six specified magnet pieces were subjected to a diffusion treatment. The diffusion treatment comprised the steps of mixing granular dysprosium fluoride mixed with ethanol to obtain a mixture, and dipping the six specified magnet pieces into the mixture while masking their surfaces except inner peripheral surfaces, and heating the dipped magnet pieces in Ar atmosphere at 900° C. for one hour. As a result of measurements, the magnetic coercive force of the diffusion-treatment surface side of the magnet piece, and the magnetic coercive force in the center of the interior thereof were 1200 kA/m and 900 kA/m, respectively. Thus, the magnetic coercive force on the diffusion-treatment surface side was increased by 300 kA/m.

These magnet pieces were secured by adhesion to a case made of SS400 (JIS) which had an inner diameter of 500 mm, an outer diameter of 580 mm, and a length of 600 mm.

In order to evaluate the obtained magnetic circuit, the magnetic field in the interior space of the magnetic circuit was measured. The magnetic field in a cylindrical space of a diameter of 170 mm and a height of 300 mm as the uniform magnetic field space was measured. A maximum value was 1.113 T and a minimum value was 1.044 T.

Comparative Example 1

Next, while each dimension and each magnetization direction in the magnetic circuit were kept same as those in Example 1, a sintered NdFeB magnet having a residual magnetization of 1.36 T and a magnetic coercive force of 1200 kA/m was used without the diffusion treatment. The magnetic field in the uniform magnetic field space generated by the fabricated magnetic circuit was measured under the same condition as that of Example 1. A maximum value was 1.066 T and a minimum value was 1.000 T.

The strength of magnetic field declined about 4% compared with that of Example 1. This decline may be considered to be caused by the residual magnetization lower by 0.06 T than that in Example 1. Comparative Example 1 simulates a conventional circuit which uses a magnet having a high magnetic coercive force and a low residual magnetization.

Example 2

Next, while each dimension and each magnetization direction in the magnetic circuit were kept same as those in Example 1, each of six specified magnet pieces was divided into two parts in the radial direction. A radial dimension of each inner magnet part to be placed in the inner periphery side was ⅕ of the radial dimension of the entire magnet piece. Sintered NdFeB magnet parts having a residual magnetization of 1.36 T and a magnetic coercive force of 1200 kA/m were placed in the inner periphery side, while a sintered NdFeB magnet pieces and sintered NdFeB magnet parts having a residual magnetization of 1.42 T and a magnetic coercive force of 900 kA/m were placed in the other positions. The magnetic field in the uniform magnetic field space generated by the fabricated magnetic circuit was measured under the same condition as that of Example 1. A maximum value was 1.112 T and a minimum value was 1.041 T.

Thus, the strength of magnetic field increased by about 4%, and the strength of magnetic field slightly decreased, compared with Comparative Example 1. The reason of this slight decrease can be considered to be that, although the residual magnetization of each divided magnet piece in the inner periphery side was lower than that in Example 1, the other magnet pieces had the same residual magnetization as in Example 1, and the volume ratio of the divided magnet piece in the inner periphery side was significantly small, and thus the magnetic field decreased in strength by only a slight amount.

Example 3

A magnetic circuit was prepared in the same manner as in Example 1 except that the outer diameter of the magnet piece was 482 mm, the case inner diameter was 482 mm, and the case outer diameter was 562 mm. Then, the magnetic field was measured in the same manner as in Example 1, resulting in a maximum value of 1.063 T and a minimum value of 1.001 T. While these measured valued were approximately the same as those of Comparative Example 1, the outer diameter of the magnetic circuit was reduced from 580 mm to 562 mm. As a result, the weight was reduced by about 80 kgf.

Comparative Example 2

A magnetic circuit was prepared in the same manner as in Example 2 except that a sintered NdFeB magnet parts having a residual magnetization of 1.38 T and a magnetic coercive force of 1100 kA/m were used as the inner magnet part in the inner periphery side. Then, the magnetic field was measured in the same manner as in Example 1, resulting in a maximum value of 1.111 T and a minimum value of 0.991 T.

Thus, the strength of minimum magnetic field decreased by about 5% compared with that of Example 2, The reason can be considered to be that, although the residual magnetization of each magnet part in the inner periphery side was slightly greater than that in Example 2, the magnetic coercive force was smaller by 100 kA/m so that demagnetization occurred, thereby decreasing the strength of magnetic field in a region close to the divided magnet parts in the uniform space.

As in Comparative Example 2, the demagnetization of a magnet cannot be prevented only by increasing the magnetic coercive force of the inner magnet parts in inner periphery side of the specified magnet pieces by 200 kA/m in comparison with those of the other magnet parts and the other magnet pieces, resulting in a decrease in strength of magnetic field.

As so far described, it is evident that by using a dipole-ring magnetic circuit according to the present invention, a uniform magnetic field space having a magnetic field strength greater than that in the conventional circuit can be produced. Further, when the magnetic field strength and the uniformity of magnetic field of a magnetic field space is the same, it is possible to provide a dipole-ring magnetic circuit according to the present invention which is smaller in size and weight than those in the conventional circuit.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

The invention claimed is:

1. A dipole-ring magnetic circuit, comprising a plurality of identically shaped permanent magnet pieces arranged in such an annular shape that magnetization directions make one rotation halfway around the annular shape, and each radial dimension of the permanent magnetic pieces is from 30 to 150 mm, wherein the permanent magnet pieces produce a substantially one-directional magnetic field at a uniform strength in an interior space which is surrounded by the permanent magnet pieces;

two or more of the permanent magnet pieces have a magnetization direction of forming an angle of from 150 to 210 degrees with respect to the direction of the magnetic field which is on a plane perpendicular to a central axis of the annular shape, and are called "specified magnet pieces"; and at least in each of the specified magnet pieces, a value of magnetic coercive force increases with decreasing distance to the interior space along a radial direction of the annular shape, and the decreasing distance is from ⅕ to 1/25 of the radial dimension of the specified magnet piece to the interior space.

2. The dipole-ring magnetic circuit according to claim 1, wherein each of the plurality of permanent magnet pieces is a NdFeB rare-earth magnet; and at least in each of the specified magnet pieces, a concentration of Dy or Tb increases with decreasing distance to the interior space along a radial direction of the annular shape.

3. A magnetic-field annealing apparatus, comprising the dipole-ring magnetic circuit according to claim 2.

4. The dipole-ring magnetic circuit according to claim 1, wherein each of the plurality of permanent magnet pieces is a NdFeB rare-earth magnet;

each of the specified magnet pieces is divided into two or more divided parts in the radial direction of the annular shape; and each of divided parts facing the interior space has a greater magnetic coercive force than that of each of the other divided parts.

5. A magnetic-field annealing apparatus, comprising the dipole-ring magnetic circuit according to claim 4.

6. The dipole-ring magnetic circuit according to claim 4, wherein a maximum difference in magnetic coercive force in the specified magnet pieces, or a maximum difference in magnetic coercive force between the specified magnet pieces and the other magnet pieces, is at least 300 kA/m.

7. A magnetic-field annealing apparatus, comprising the dipole-ring magnetic circuit according to claim 6.

8. The dipole-ring magnetic circuit according to claim 1, wherein each of the plurality of permanent magnet pieces is a NdFeB rare-earth magnet, and each of the specified magnet pieces has a greater magnetic coercive force than that of each of the plurality of the permanent magnet pieces other than the specified magnet pieces.

9. A magnetic-field annealing apparatus, comprising the dipole-ring magnetic circuit according to claim 8.

10. The dipole-ring magnetic circuit according to claim 1, wherein a maximum difference in magnetic coercive force in the specified magnet pieces, or a maximum difference in magnetic coercive force between the specified magnet pieces and the other magnet pieces, is at least 300 kA/m.

11. A magnetic-field annealing apparatus, comprising the dipole-ring magnetic circuit according to claim 1.

* * * * *